US008453267B1

(12) United States Patent
Stanley

(10) Patent No.: US 8,453,267 B1
(45) Date of Patent: Jun. 4, 2013

(54) DECORATIVE APPAREL SYSTEM

(76) Inventor: Tabitha E. Stanley, Clearwater, FL (US)

( * ) Notice: Subject to any disclaimer, the term of this patent is extended or adjusted under 35 U.S.C. 154(b) by 775 days.

(21) Appl. No.: 12/283,734

(22) Filed: Sep. 15, 2008

(51) Int. Cl.
*A41D 27/08* (2006.01)
*A41D 1/06* (2006.01)

(52) U.S. Cl.
USPC ..... 2/244; 2/227

(58) Field of Classification Search
USPC ..... 2/227, 231, 232, 233, 244, 247, 249, 2/251, 269
See application file for complete search history.

(56) References Cited

U.S. PATENT DOCUMENTS

| | | | | |
|---|---|---|---|---|
| 1,023,864 | A * | 4/1912 | Miller | 2/232 |
| 1,527,825 | A * | 2/1925 | Baggerud | 36/2 R |
| 2,111,945 | A * | 3/1938 | Segelin et al. | 2/232 |
| 2,671,902 | A * | 3/1954 | Grue | 40/586 |
| 2,677,829 | A * | 5/1954 | Rothstein et al. | 2/232 |
| 2,936,460 | A * | 5/1960 | Jackson | 40/586 |
| 3,438,062 | A * | 4/1969 | Dobell | 2/247 |
| 3,828,368 | A * | 8/1974 | Lam | 2/227 |
| 3,840,901 | A * | 10/1974 | Eyster | 2/247 |
| 4,215,435 | A * | 8/1980 | Miele | 2/227 |
| 4,218,781 | A * | 8/1980 | Lieberman | 2/247 |
| 4,446,573 | A * | 5/1984 | Green | 2/252 |
| 4,513,454 | A * | 4/1985 | Anderson et al. | 2/246 |
| 4,532,656 | A * | 8/1985 | Suzuki | 2/247 |
| 4,613,991 | A * | 9/1986 | Grover | 2/23 |
| 4,651,355 | A * | 3/1987 | White | 2/247 |
| 5,054,127 | A * | 10/1991 | Zevchak | 2/247 |
| 5,136,726 | A * | 8/1992 | Kellin et al. | 2/244 |
| 5,416,928 | A | 5/1995 | Koenig | |
| 5,794,267 | A * | 8/1998 | Wallace | 2/227 |
| 5,901,372 | A * | 5/1999 | Lawler | 2/69 |
| 5,956,775 | A * | 9/1999 | Ezra | 2/227 |
| 6,041,436 | A * | 3/2000 | Keen | 2/69 |
| 6,233,747 | B1 * | 5/2001 | Barker | 2/247 |
| D456,981 | S * | 5/2002 | Connell | D2/853 |
| 6,519,779 | B1 * | 2/2003 | Taguchi | 2/209.12 |
| 6,611,964 | B2 * | 9/2003 | Lipsett et al. | 2/227 |
| D490,216 | S * | 5/2004 | Powell | D2/853 |
| 6,769,139 | B1 * | 8/2004 | Goldkind | 2/247 |
| 6,769,204 | B1 | 8/2004 | Phillips | |
| 6,968,573 | B2 * | 11/2005 | Silver | 2/227 |
| 7,181,774 | B2 * | 2/2007 | Silver | 2/227 |
| D537,610 | S * | 3/2007 | Escamillo | D2/857 |
| 7,231,671 | B2 * | 6/2007 | Allen | 2/227 |
| 7,712,154 | B1 * | 5/2010 | Adams-Zarrella | 2/247 |
| 7,721,571 | B2 * | 5/2010 | Rose et al. | 63/33 |
| 7,748,058 | B2 * | 7/2010 | Steitle | 2/244 |
| 2003/0172430 | A1 * | 9/2003 | Jarrett | 2/69 |
| 2003/0221244 | A1 * | 12/2003 | Liddell | 2/244 |
| 2004/0040068 | A1 * | 3/2004 | Silver | 2/227 |
| 2004/0199980 | A1 * | 10/2004 | Silver | 2/227 |
| 2005/0000002 | A1 * | 1/2005 | Levy et al. | 2/244 |
| 2005/0044610 | A1 * | 3/2005 | Grimes | 2/244 |
| 2005/0198724 | A1 * | 9/2005 | Steitle et al. | 2/244 |
| 2006/0107441 | A1 * | 5/2006 | Houdroge | 2/227 |
| 2006/0185065 | A1 * | 8/2006 | Allen | 2/237 |
| 2006/0277660 | A1 * | 12/2006 | MacMillan | 2/232 |
| 2007/0118957 | A1 * | 5/2007 | Steitle | 2/69 |
| 2007/0136930 | A1 * | 6/2007 | Dipietro | 2/227 |

(Continued)

*Primary Examiner* — Alissa L Hoey

(57) ABSTRACT

A nether garment has upper and lower sections and seams. Primary fasteners are attached to the lower section forwardly between the seams. Removable patches have inner and outer surfaces. Complementary fasteners attached to the inner surface of each removable patch are adjacent to and coupleable with the primary fasteners.

1 Claim, 4 Drawing Sheets

U.S. PATENT DOCUMENTS

2007/0214547 A1* 9/2007 Mullen ..... 2/227
2007/0245469 A1* 10/2007 Young ..... 2/458
2007/0271683 A1* 11/2007 McCrary et al. ..... 2/244
2007/0294806 A1* 12/2007 Harazi ..... 2/244
2008/0289072 A1* 11/2008 Shin ..... 2/23
2009/0106881 A1* 4/2009 Delinski ..... 2/409
2009/0158502 A1* 6/2009 Medolla et al. ..... 2/227
2009/0178180 A1* 7/2009 Harris ..... 2/244
2010/0083422 A1* 4/2010 Lebl ..... 2/251
2010/0170026 A1* 7/2010 Jeffords ..... 2/227
2010/0175168 A1* 7/2010 Yari ..... 2/244
2010/0199399 A1* 8/2010 Garza ..... 2/24
2010/0212069 A1* 8/2010 Williams et al. ..... 2/244
2010/0293700 A1* 11/2010 Gillespie et al. ..... 2/244

* cited by examiner

FIG 3
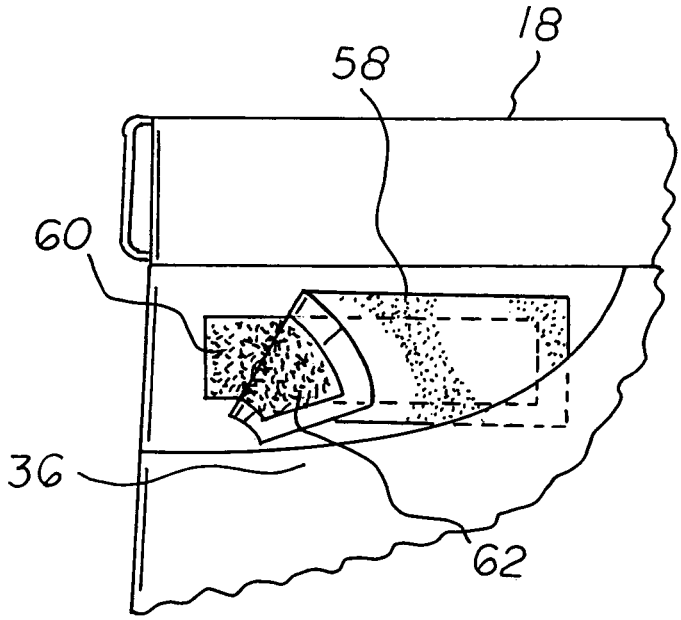
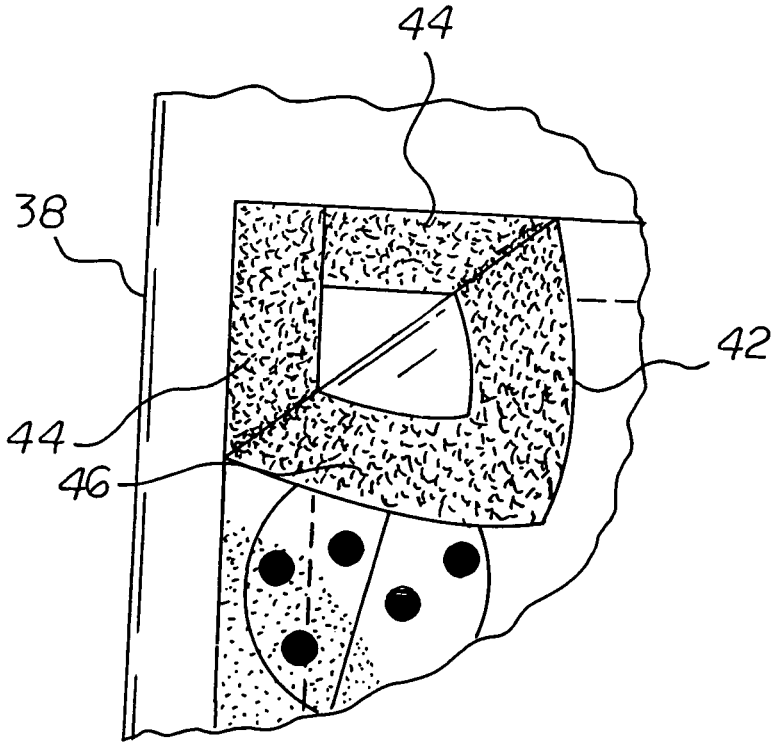
FIG 4

FIG 5
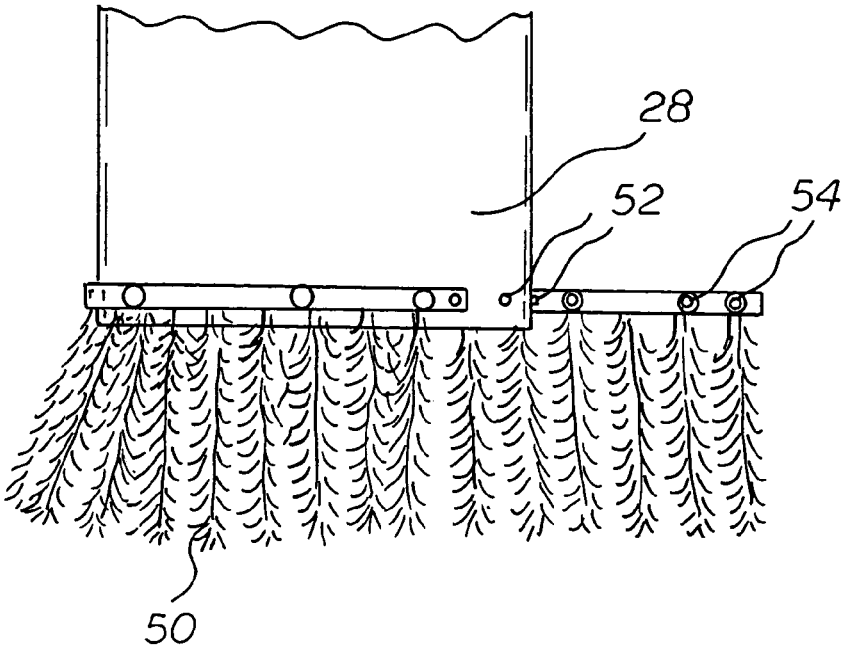
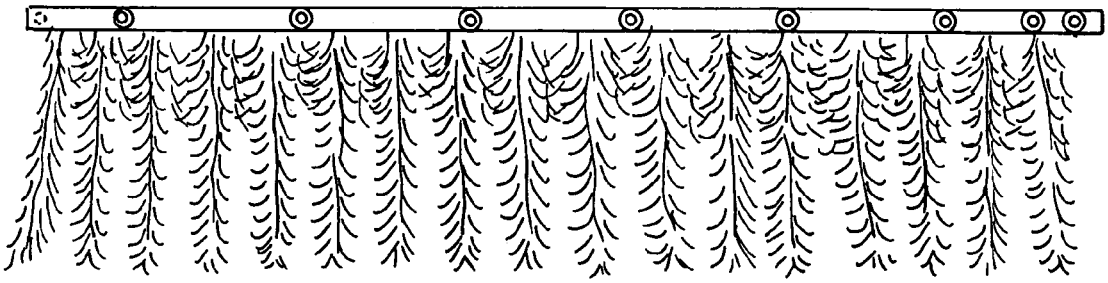
FIG 6

DECORATIVE APPAREL SYSTEM

BACKGROUND OF THE INVENTION

1. Field of the Invention

The present invention relates to a decorative apparel system and more particularly pertains to for varying the ornamental appearance of pants at the discretion of a wearer in a safe, attractive, convenient and economical manner.

2. Description of the Prior Art

The use of apparel decorations of known designs and configurations is known in the prior art. More specifically, apparel decorations of known designs and configurations previously devised and utilized for the purpose of decorating apparel through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,769,204 issued Aug. 3, 2004 to Phillips relates to a Sandal System and U.S. Pat. No. 5,416,928 issued May 23, 1995 to Koenig relates to a Versatile Garment Attachment and Article of Clothing.

While these devices fulfill their respective, particular objectives and requirements, the aforementioned patents do not describe a decorative apparel system that allows for varying the ornamental appearance of pants at the discretion of a wearer in a safe, attractive, convenient and economical manner.

In this respect, the decorative apparel system according to the present invention substantially departs from the conventional concepts and designs of the prior art, and in doing so provides an apparatus primarily developed for the purpose of for varying the ornamental appearance of pants at the discretion of a wearer in a safe, attractive, convenient and economical manner.

Therefore, it can be appreciated that there exists a continuing need for a new and improved decorative apparel system which can be used for varying the ornamental appearance of pants at the discretion of a wearer in a safe, attractive, convenient and economical manner. In this regard, the present invention substantially fulfills this need.

SUMMARY OF THE INVENTION

In view of the foregoing disadvantages inherent in the known types of apparel decorations of known designs and configurations now present in the prior art, the present invention provides an improved decorative apparel system. As such, the general purpose of the present invention, which will be described subsequently in greater detail, is to provide a new and improved decorative apparel system and method which has all the advantages of the prior art and none of the disadvantages.

To attain this, the present invention essentially comprises a decorative apparel system. First provided is a pair of pants. The pants have an upper section. The upper section is provided above. The upper section is adapted to encompass the lower mid-section of a wearer. The upper section has a single waist opening. In this manner the waist of a wearer is received. The upper section has a pair of leg openings. In this manner the thighs of a wearer are received.

The pair of pants has a lower section. The lower section is provided below. The lower section is adapted to encompass the legs of a wearer. The lower section has two similarly configured tubular leg components. Each leg component has an upper end. The upper end is integrally formed with the leg openings of the upper section. Each leg component has a free lower end. In this manner a lower leg of a wearer is received. The leg components have interior faces. The interior faces are provided in facing contact with each other. The leg components have oppositely facing exterior faces. The exterior faces are fully visible to third parties when worn.

The pair of pants includes front and rear pockets. The front pockets are provided in the upper section. The front pockets are located above the exterior faces of the leg components. The front pockets are spaced beneath the waist opening. The pair of pants includes linear in-seams and linear side seams. The linear in-seams are provided on the interior faces of the leg components. The linear side seams are provided on the exterior faces of the leg components. The linear seams extend forwardly between the upper and lower ends.

Provided next is a plurality of pairs of decorative removable patches. Each removable patch has inner and outer surfaces. In this manner a rectangular configuration is defined. The removable patch has short upper and lower edges. The removable patch has long side edges. Primary strips of hook and loop fasteners are provided. The primary strips are attached to the leg components. The primary strips include long strips. The long strips are provided between the in-seam and the side seam and parallel with the seams. The primary strips also include short strips. The short strips are provided between the long strips. The short strips are provided adjacent to the upper and lower ends of the leg components. Complementary strips of hook and loop fasteners are provided. The complementary strips are attached to the inner surface of each removable patch. The complementary strips include long strips. The long strips are provided adjacent to the side edges of the removable patch. The long strips are coupleable with the side edges of the removable patch. The complementary strips include short strips. The short strips are provided adjacent to the upper and lower edges of the removable patch. The short strips are coupleable with the upper and lower edges of the removable patch. Each pair of removable patches has a distinctive design on its outer surface. In this manner a wearer is allowed to removably attach removable patches to the leg components of a pair of pants. Further in this manner the pants may be suited for a particular occasion and mood of a wearer.

Further provided are pairs of lower attachments. Each lower attachment is in a rectangular configuration. Each lower attachment has an interior and an exterior face. Each lower attachment has outwardly facing snap elements. The outwardly facing snap elements are provided on the leg components adjacent to their lower ends. Each lower attachment has inwardly facing complementary snap elements. The inwardly facing complementary snap elements are provided on the interior faces of the lower attachments. In this manner the lower attachments are removably coupled to leg components. Each pair of lower attachments has a distinctive design on its outer surface. In this manner a wearer may removably attach lower attachments to the leg components of a pair of pants. Further in this manner the pants may be suited for a particular occasion and mood of a wearer.

Provided next are pairs of front pocket attachments. Each front pocket attachment is in a rectangular configuration. Each front pocket attachment has an interior and an exterior face. Each front pocket attachment has outwardly facing hook and loop elements. The outwardly facing hook and loop elements are provided on the upper section above the front pockets. Each front pocket attachment has inwardly facing complementary hook and loop elements. The inwardly facing complementary hook and loop elements are provided on the interior faces of the front pocket attachments. In this manner the front pocket attachments are removably coupled to the upper section of the pants. Each pair of front pocket attachments has a distinctive design on its outer surface. In this manner a wearer may removably attach front pocket attachments to the upper section of a pair of pants. Further in this manner the pants may be suited for a particular occasion and mood of a wearer.

Provided last are pairs of rear pocket attachments. Each rear pocket attachment is in a trapezoidal configuration. Each rear pocket attachment has an interior and an exterior face. Each rear pocket attachment has outwardly facing hook and loop elements. The outwardly facing hook and loop elements are provided on the upper section above the rear pockets. Each rear pocket attachment has inwardly facing complementary hook and loop elements. The inwardly facing complementary hook and loop elements are provided on the interior faces of the rear pocket attachments. In this manner the rear pocket attachments are removably coupled to the upper section of the pants. Each pair of rear pocket attachments has a distinctive design on its outer surface. In this manner a wearer may removably attach rear pocket attachments to the upper section of a pair of pants. Further in this manner the pants may be suited for a particular occasion and mood of a wearer.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved decorative apparel system which has all of the advantages of the prior art apparel decorations of known designs and configurations and none of the disadvantages.

It is another object of the present invention to provide a new and improved decorative apparel system which may be easily and efficiently manufactured and marketed.

It is further object of the present invention to provide a new and improved decorative apparel system which is of durable and reliable constructions.

An even further object of the present invention is to provide a new and improved decorative apparel system which is susceptible of a low cost of manufacture with regard to both materials and labor, and which accordingly is then susceptible of low prices of sale to the consuming public, thereby making such decorative apparel system economically available to the buying public.

Even still another object of the present invention is to provide a decorative apparel system for varying the ornamental appearance of pants at the discretion of a wearer in a safe, attractive, convenient and economical manner.

Lastly, it is an object of the present invention to provide a new and improved decorative apparel system wherein a nether garment has upper and lower sections and seams with primary fasteners attached to the lower section forwardly between the seams; removable patches have inner and outer surfaces; and complementary fasteners, attached to the inner surface of each removable patch, are adjacent to and coupleable with the primary fasteners.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 an enlarged showing of the front pocket region of Circle 3 as shown in FIG. 1.

FIG. 4 an enlarged showing of the leg region of Circle 4 as shown in FIG. 1.

FIGS. 5 and 6 are enlarged showings of the lower region shown in FIG. 1 both on the pants and off of the pants.

The same reference numerals refer to the same parts throughout the various Figures.

DESCRIPTION OF THE PREFERRED EMBODIMENT

Figure 1:
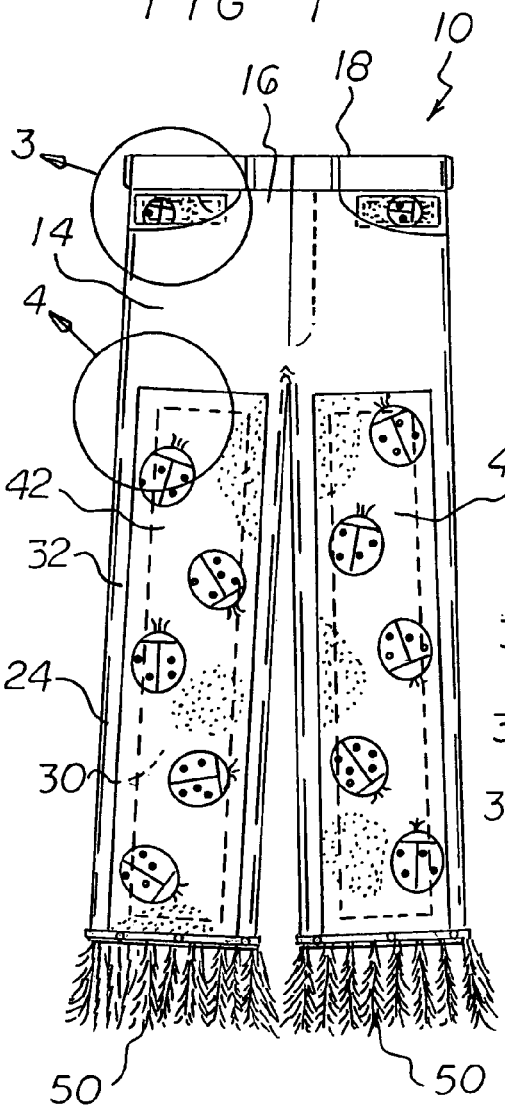
FIG. 1 is a front elevational view of a decorative apparel system constructed in accordance with the principles of the present invention.
Figure 2:
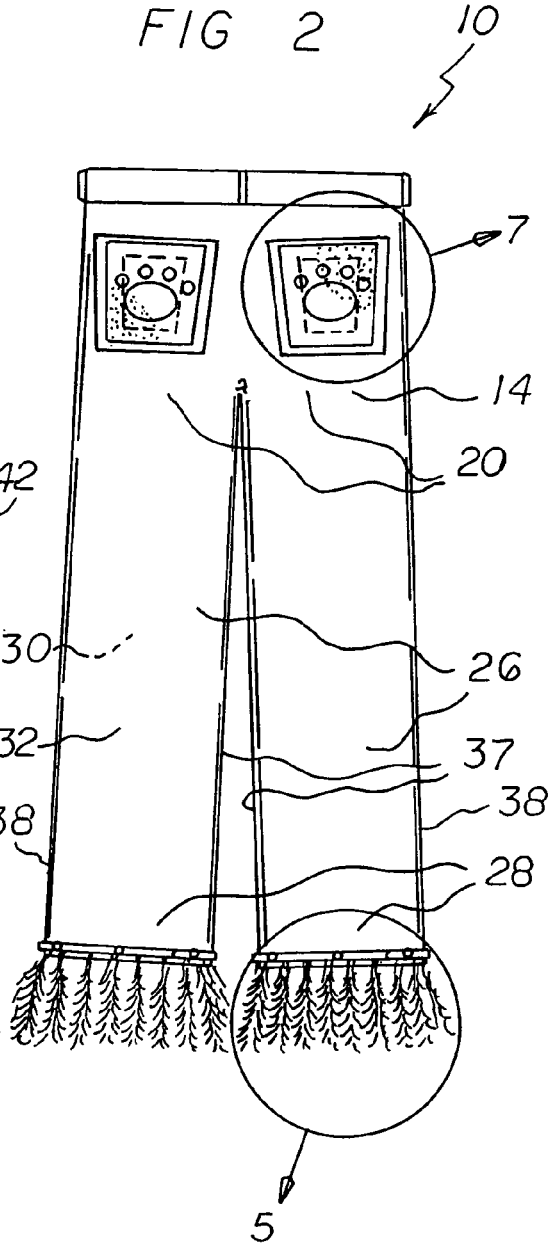
FIG. 2 is a rear elevational view of the system shown in FIG. 1.
Figure 7:
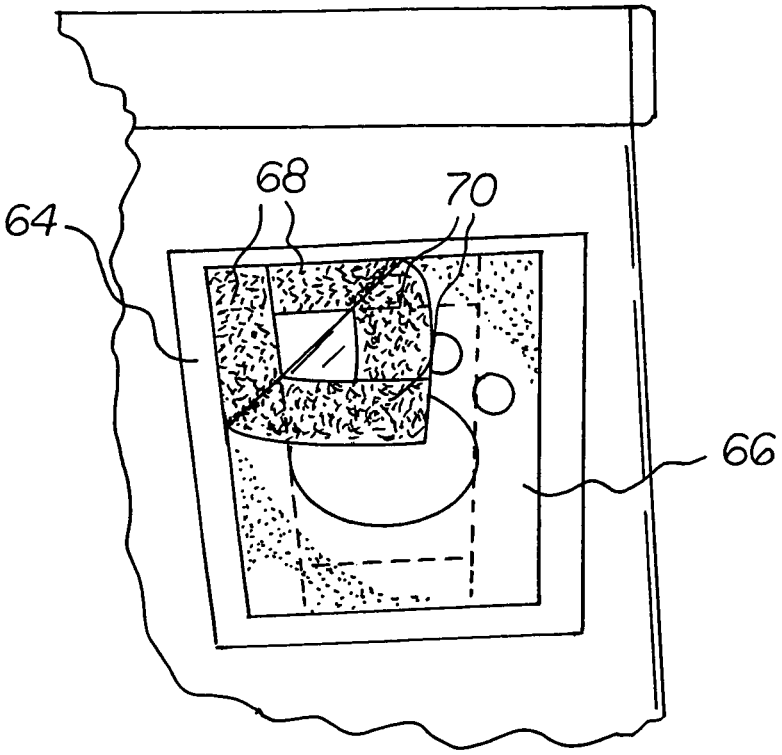
FIG. 7 an enlarged showing of the rear pocket region of Circle 7 as shown in FIG. 2.

With reference now to the drawings, and in particular to FIG. 1 thereof, the preferred embodiment of the new and improved decorative apparel system embodying the principles and concepts of the present invention and generally designated by the reference numeral 10 will be described.

The present invention, the decorative apparel system 10 is comprised of a plurality of components. Such components in their broadest context include a pair of pants and removable patches. Such components are individually configured and correlated with respect to each other so as to attain the desired objective.

First provided is a pair of pants 14. Although a pair of pants is the preferred embodiment of the invention, it should be understood that the present invention is adaptable for use with any nether garment, i.e., long pants, short pants, shorts, knickers, skirts, or the like. The pants of the primary embodiment have an upper section 16. The upper section is provided above. The upper section is adapted to encompass the mid-section of a wearer. The upper section has a single waist opening 18. In this manner the waist of a wearer is received. The upper section has a pair of leg openings 20. In this manner the thighs of a wearer are received.

The pair of pants has a lower section 24. The lower section is provided below. The lower section is adapted to encompass the legs of a wearer. The lower section has two similarly configured tubular leg components 26. Each leg component has an upper end. The upper end is integrally formed with the leg openings of the upper section. Each leg component has a free lower end 28. In this manner the lower leg of a wearer is received. The leg components have interior faces 30. The interior faces are provided in facing contact with each other. The leg components have oppositely facing exterior faces 32. The exterior faces are fully visible to third parties when worn.

The pair of pants includes front pockets 36. The front pockets are provided in the upper section. The front pockets are located above the exterior faces of the leg components. The front pockets are spaced beneath the waist opening. The pair of pants includes linear in-seams 37 and side seams 38. The linear in-seams are provided on the interior faces of the leg components. The linear side seams are provided on the exterior faces of the leg components. The linear seams extend between the upper and lower ends.

Provided next is a plurality of pairs of decorative removable patches 42. Each removable patch has inner and outer surfaces. In this manner a rectangular configuration is defined. The removable patch has short upper and lower edges. The removable patch has long side edges. Primary strips 44 of hook and loop fasteners are provided. The primary strips are attached to the leg components. The primary strips include long strips. The long strips are provided between the in-seams and the side seam and parallel with the side seam. The primary strips also include short strips. The short strips are provided between the long strips. The short strips are provided adjacent to the upper and lower ends of the leg components. Complementary strips 46 of hook and loop fasteners are provided. The complementary strips are attached to the inner surface of each removable patch. The complementary strips include long strips. The long strips are provided adjacent to the side edges of the removable patch. The long strips are coupleable with the side edges of the removable patch. The complementary strips include short strips. The short strips are provided adjacent to the upper and lower edges of the removable patch. The short strips are coupleable with the upper and lower edges of the removable patch. Each pair of removable patches has a distinctive design on its outer surface. In this manner a wearer is allowed to removably attach removable patches to the leg components of a pair of pants. Further in this manner the pants may be suited for a particular occasion and mood of a wearer.

Further provided are pairs of lower attachments 50. Each lower attachment is in a rectangular configuration. Each lower attachment has an interior and an exterior face. Each lower attachment has outwardly facing snap elements 52. The outwardly facing snap elements are provided on the leg components adjacent to their lower ends. Each lower attachment has inwardly facing complementary snap elements 54. The inwardly facing complementary snap elements are provided on the interior faces of the lower attachments. In this manner the lower attachments are removably coupled to leg components. Each pair of lower attachments has a distinctive design on its outer surface, feathers in the preferred embodiment. In this manner a wearer may removably attach lower attachments to the leg components of a pair of pants. Further in this manner the pants may be suited for a particular occasion and mood of a wearer.

Provided next are pairs of front pocket attachments 58. Each front pocket attachment is in a rectangular configuration. Each front pocket attachment has an interior and an exterior face. Each front pocket attachment has outwardly facing hook and loop elements 60. The outwardly facing hook and loop elements are provided on the upper section above the front pockets. Each front pocket attachment has inwardly facing complementary hook and loop elements 62. The inwardly facing complementary hook and loop elements are provided on the interior faces of the pocket attachments. In this manner the front pocket attachments are removably coupled to the upper section of the pants. Each pair of front pocket attachments has a distinctive design on its outer surface. In this manner a wearer may removably attach front pocket attachments to the upper section of a pair of pants. Further in this manner the pants may be suited for a particular occasion and mood of a wearer.

Provided last are a pair of rear pockets 64 with pairs of rear pocket attachments 66. Each rear pocket attachment is in a trapezoidal configuration. Each rear pocket attachment has an interior and an exterior face. Each rear pocket attachment has outwardly facing hook and loop elements 68. The outwardly facing hook and loop elements are provided on the upper section above the rear pockets. Each rear pocket attachment has inwardly facing complementary hook and loop elements 70. The inwardly facing complementary hook and loop elements are provided on the interior faces of the pocket attachments. In this manner the rear pocket attachments are removably coupled to the upper section of the pants. Each pair of rear pocket attachments has a distinctive design on its outer surface. In this manner a wearer may removably attach rear pocket attachments to the upper section of a pair of pants. Further in this manner the pants may be suited for a particular occasion and mood of a wearer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A decorative apparel system for varying the ornamental appearance of pants at the discretion of a wearer in a safe, attractive, convenient and economical manner, the system comprising, in combination:

a pair of pants having an upper section above adapted to encompass the mid-section of a wearer below the waist, the upper section having a single waist opening for receiving the waist of a wearer, the upper section having a pair of leg openings for receiving the thighs of a wearer;

the pair of pants having a lower section below adapted to encompass the legs of a wearer, the lower section having two similarly configured tubular leg components, each leg component having an upper end integrally formed with the leg openings of the upper section, each leg component having a free lower end for receiving a leg of a wearer, the leg components having interior faces in facing contact with each other and oppositely facing exterior faces;

the pair of pants being cut to include front and rear pockets in the upper section, the front pockets being located above the exterior faces of the leg components, the front pockets being spaced beneath the waist opening, the pair of pants being cut to include linear in-seams on the interior faces and side seams on the exterior faces of the leg components extending forwardly between the upper and lower ends;

a plurality of pairs of decorative removable patches, each removable patch having inner and outer surfaces and defining a rectangular configuration with short upper and lower edges and with long side edges, primary strips of hook and loop fasteners attached to the leg components, the primary strips including long strips between the in-seams and the side seam and parallel there with, the primary strips also including short strips between the long strips adjacent to the upper and lower ends of the leg components, complementary strips of hook and loop fasteners attached to the inner surface of each removable patch, the complementary strips including long strips adjacent to and coupleable with the side edges of the removable patch and short strips adjacent to and coupleable with the upper and lower edges of the removable patch, each pair of removable patches having a distinctive design on its outer surface allowing a wearer to removably attach removable patches to the leg components of a pair of pants to suit a particular occasion and mood of a wearer;

pairs of lower leg attachments, each lower leg attachment being in a rectangular configuration with an interior and an exterior face, outwardly facing snap elements on the leg components adjacent to their lower ends, inwardly facing complementary snap elements on the interior faces of the lower attachments for removably coupling the lower attachments to leg components, each pair of lower attachments having a distinctive design on its outer surface in the form of feathers allowing a wearer to removably attach lower attachments to the leg components of a pair of pants to suit a particular occasion and mood of a wearer;

pairs of front pocket attachments, each front pocket attachment being in a rectangular configuration with an interior and an exterior face, outwardly facing hook and loop elements on the upper section above the front pockets, inwardly facing complementary hook and loop elements on the interior faces of the front pocket attachments for removably coupling the front pocket attachments to the upper section of the pants, each pair of front pocket attachments having a distinctive design on its outer surface allowing a wearer to removably attach the front pocket attachments to the upper section of a pair of pants to suit a particular occasion and mood of a wearer; and pairs of rear pocket attachments, each rear pocket attachment being in a trapezoidal configuration with an interior and an exterior face, outwardly facing hook and loop elements on the upper section above the rear pockets, inwardly facing complementary hook and loop elements on the interior faces of the rear pocket attachments for removably coupling the rear pocket attachments to the upper section of the pants, each pair of rear pocket attachments having a distinctive design on its outer surface allowing a wearer to removably attach pocket attachments to the upper section of a pair of pants to suit a particular occasion and mood of a wearer.

* * * * *